US007118456B2

(12) United States Patent
Moloney et al.

(10) Patent No.: US 7,118,456 B2
(45) Date of Patent: Oct. 10, 2006

(54) POLISHING HEAD, RETAINING RING FOR USE THEREWITH AND METHOD FO POLISHING A SUBSTRATE

(75) Inventors: Gerard S. Moloney, Milpitas, CA (US); Jiro Kajiwara, Saitama-ken (JP)

(73) Assignee: Multiplanar Technologies Incorporated, San Jose, CA (US)

( * ) Notice: Subject to any disclaimer, the term of this patent is extended or adjusted under 35 U.S.C. 154(b) by 0 days.

(21) Appl. No.: 10/349,769

(22) Filed: Jan. 22, 2003

(65) Prior Publication Data

US 2003/0171076 A1 Sep. 11, 2003

Related U.S. Application Data

(60) Provisional application No. 60/351,671, filed on Jan. 22, 2002.

(51) Int. Cl.
*B24B 1/00* (2006.01)
*B24B 41/06* (2006.01)
*B24B 5/00* (2006.01)

(52) U.S. Cl. ..... 451/41; 451/285; 451/398

(58) Field of Classification Search ..... 451/41, 451/388, 285–287, 390, 394, 397, 398
See application file for complete search history.

(56) References Cited

U.S. PATENT DOCUMENTS 2,826,009 A * 3/1958 Shurson ..... 451/286
5,597,346 A 1/1997 Hempel, Jr.
5,643,061 A * 7/1997 Jackson et al. ..... 451/289
5,695,392 A 12/1997 Kim
5,944,593 A * 8/1999 Chiu et al. ..... 451/442
6,224,472 B1 5/2001 Lai et al.
6,241,582 B1 * 6/2001 Lin et al. ..... 451/41
6,267,643 B1 * 7/2001 Teng et al. ..... 451/41
6,527,624 B1 * 3/2003 Tolles et al. ..... 451/41
2002/0017365 A1 2/2002 Gunji et al.

* cited by examiner

*Primary Examiner*—Hadi Shakeri
(74) *Attorney, Agent, or Firm*—Dorsey & Whitney LLP

(57) ABSTRACT

A polishing apparatus is provided for removing material from a surface of a substrate. The apparatus includes a polishing head for positioning a surface of a substrate against a polishing surface of the apparatus. The polishing head includes a subcarrier adapted to hold the substrate during a polishing operation, and a retaining ring having an inner edge disposed about the subcarrier and a lower surface in contact with the polishing surface during the polishing operation, the lower surface of the retaining ring having a number of radial recesses formed therein to distribute a chemical between the substrate held on the subcarrier and the polishing surface when there is relative motion between the substrate and the polishing surface, thereby inhibiting non-planar polishing of the surface of the substrate. Preferably, the number of radial recesses comprise at least one groove adapted to transport the chemical from an area near an outer edge of the retaining ring to an area near an inner edge of the retaining ring. More preferably, the groove comprises a chevron shape between the outer and inner edge of the retaining ring.

14 Claims, 6 Drawing Sheets

POLISHING HEAD, RETAINING RING FOR USE THEREWITH AND METHOD FO POLISHING A SUBSTRATE

REFERENCE TO RELATED APPLICATIONS

This application claims priority to U.S. Provisional Application Ser. No. 60/351,671, entitled Chemical Mechanical Polishing Apparatus And Method Having A Retaining Ring With A Contoured Surface For Slurry Distribution, filed Jan. 22, 2002, which is incorporated herein by reference.

FIELD OF THE INVENTION

This invention pertains generally to systems, devices, and methods for polishing and planarizing substrates, and more particularly to an apparatus and method for distributing slurry on a polishing surface of a chemical mechanical polishing (CMP) apparatus.

BACKGROUND OF THE INVENTION

As feature size decreases, density increases, and the size of semiconductor wafers or substrates increase, Chemical Mechanical Planarization (CMP) process requirements become more stringent. Substrate to substrate process uniformity as well as intra-substrate planarization uniformity are important issues from the standpoint of producing semiconductor products at a low cost. As the size of dies increases a flaw in one small area increasingly results in rejection of a relatively large circuit so that even small flaws have relatively large economic consequences in the semiconductor industry.

Many factors are known in the art to contribute to uniformity problems. These include distribution of a slurry between a surface of the substrate and a polishing surface during the polishing operation when there is relative motion between a polishing head on which the substrate is held and the polishing surface during the polishing operation. Slurry is a, usually, chemically active liquid having an abrasive material suspended therein that is used to enhance the rate at which material is removed from the substrate surface.

Referring to FIG. 1, a typical CMP apparatus 10 includes (i) a platen 12 having a polishing surface 14 thereon; (ii) a polishing head 16 adapted to hold a substrate 18 against the polishing surface during a polishing operation; (iii) a drive mechanism (not shown) to rotate the platen 12 providing a relative motion between the polishing head 16 and the polishing surface 14 during the polishing operation; and (iv) a dispenser (not shown) adapted to dispense a slurry on the polishing surface 14 during the polishing operation. The polishing head 16 includes a carrier 19 having a subcarrier 20 with a lower surface 22 for pressing the substrate 18 against the polishing surface 14 during the polishing operation, and a retaining ring 24 circumferentially disposed about the subcarrier. The retaining ring 24 generally restrains or limits lateral movement of the substrate 18 relative to the subcarrier 20 to hold or retain the substrate between the subcarrier and the polishing surface.

One problem with a conventional CMP apparatus 10 is a non-uniform distribution of slurry between a surface 26 of the substrate 18 and the polishing surface 14 during the polishing operation. This is a result of a substantial portion of the slurry being directed around the polishing head 16 by the retaining ring 24, rather than passing under the retaining ring into the space between the substrate surface 26 and the polishing surface 14. Moreover, the limited or reduced amount of slurry that does enter this space is usually insufficient to flush out or remove the used slurry and/or solid polishing byproducts that can build up at a trailing edge 28 of the retaining ring 24 and damage the substrate 18.

Another related problem with conventional CMP apparatuses 10 and methods, is friction induced vibration during polishing due to non-uniform slurry distribution between the substrate surface 26 and the polishing surface 14.

Accordingly, there is a need for an apparatus and method that provides a uniform distribution of slurry between the surface of the substrate and the polishing surface during a polishing operation. There is a further need for an apparatus and method capable of reducing or eliminating friction induced vibration during the polishing operation. There is a yet further need for an apparatus and method capable of removing used slurry and polishing byproducts from under the surface of the substrate during the polishing operation thereby eliminating buildup of solid polishing byproducts that can damage the substrate.

SUMMARY

The present invention relates to an apparatus and method for distributing slurry on a polishing surface of a CMP apparatus that achieves a high-planarization uniformity across a surface of a substrate.

According to one aspect of the present invention, a polishing apparatus is provided for removing material from a surface of a substrate. The polishing apparatus includes a polishing head for positioning a surface of a substrate against a polishing surface of the apparatus. Generally, the polishing head includes: (i) a subcarrier adapted to hold the substrate during a polishing operation; and (ii) a retaining ring having an inner edge disposed about the subcarrier and a lower surface in contact with the polishing surface during the polishing operation, the lower surface of the retaining ring having a number of radial recesses formed therein to distribute a chemical between the substrate held on the subcarrier and the polishing surface when there is relative motion between the substrate and the polishing surface, thereby inhibiting non-planar polishing of the surface of the substrate.

Preferably, the number of radial recesses comprise at least one groove adapted to transport the chemical from an area near an outer edge of the retaining ring to an area near an inner edge of the retaining ring. In one embodiment, the groove comprises a chevron shape between the outer and inner edge of the retaining ring. More preferably, the chevron shape is oriented such that an apex of the chevron points in a direction corresponding to a direction of rotation of the retaining ring or polishing head. Alternatively, the chevron shape can be oriented such that an apex of the chevron points in a direction opposite to a direction of rotation of the retaining ring or polishing head. In yet another alternative, the apex of the chevron of alternating grooves point in opposite directions. That is, the chevron shape of a first groove is oriented such that the apex of the chevron points in a direction corresponding to the direction of rotation of the retaining ring or polishing head, and the chevron shape of a second groove adjacent to the first is oriented such that the apex of the chevron points in a direction corresponding to the direction opposite to the direction of rotation of the retaining ring or polishing head.

In another embodiment, the groove comprises a curved shape or line between the outer and inner edge of the retaining ring. In one version of this embodiment, the groove comprises an arced shape between the outer and inner edge of the retaining ring.

In another embodiment, the groove comprises a straight line shape between the outer and inner edge of the retaining ring. Generally, the straight line shape forms an angle relative a radius of the retaining ring. It will be appreciated that where the retaining ring includes a number of grooves, each of the different grooves need not be angled in the same direction or to the same degree as the other grooves.

In another aspect of the present invention, a polishing head is provided for positioning a surface of a substrate against a polishing surface. The polishing head generally includes a subcarrier adapted to hold the substrate during a polishing operation, and a retaining ring having an inner edge disposed about the subcarrier and a lower surface in contact with the polishing surface during the polishing operation. In accordance with the present invention, the lower surface of the retaining ring has a number of radial grooves formed therein to distribute a polishing liquid between the substrate held on the subcarrier and the polishing surface when there is relative motion between the substrate and the polishing surface. In one embodiment, the grooves include an angle between an outer and inner edge of the retaining ring and the directions of each groove at the inner edge and the outer edge of the retaining ring are oriented to a same direction with respect to a direction of a rotation of the retaining ring.

In one embodiment, the grooves include at least one groove having an arced shape. In another embodiment, the grooves include at least one groove having a chevron shape having an apex between the outer and inner edge of the retaining ring to make a polishing liquid stagnation about said apex of the groove. In one version of this embodiment, the all of the grooves have a chevron shape, and each chevron shape groove includes an angle oriented in a direction opposite that of an adjacent groove.

In yet another aspect, the invention is directed to a method of polishing a substrate having a surface using a polishing apparatus having a polishing surface and a polishing head having a subcarrier and a retaining ring having an inner edge disposed about the subcarrier and a lower surface in contact with the polishing surface during the polishing operation, the lower surface of the retaining ring having a plurality of radial recesses formed therein. Generally, the method involves: (i) positioning the substrate on the subcarrier; (ii) pressing the surface of the substrate and the lower surface of the retaining ring against the polishing surface; (iii) dispensing a chemical onto the polishing surface; (iv) providing relative motion between the polishing head and the polishing surface; and (v) distributing the chemical between the substrate held on the subcarrier and the polishing surface through the plurality of radial recesses.

Advantages of the apparatus and method of the present invention include any or all of the following:

(i) improved planarization uniformity due to a more uniform distribution of slurry between the surface of the substrate and the polishing surface;

(ii) improved planarization uniformity of substrates due to substantial elimination of friction induced vibration during polishing due to non-uniform slurry distribution between the surface of the substrate and the polishing surface; and (iii) reduced wasting of slurry, due to tailored or focused distribution of slurry across the polishing surface.

BRIEF DESCRIPTION OF THE DRAWINGS

These and various other features and advantages of the present invention will be apparent upon reading of the following detailed description in conjunction with the accompanying drawings, where.

DETAILED DESCRIPTION

The inventive structure and method are now described in the context of specific exemplary embodiments illustrated in the figures. Those skilled in the art will appreciate that various changes and modifications can be made while remaining within the scope of the claimed invention. For example, for purposes of clarity the invention is described in context of a Chemical Mechanical Polishing (CMP) system having a single polishing head. However, those skilled in the art will appreciate that the apparatus and method of the invention can also be utilized with CMP systems having multiple polishing heads.

Figure 1:
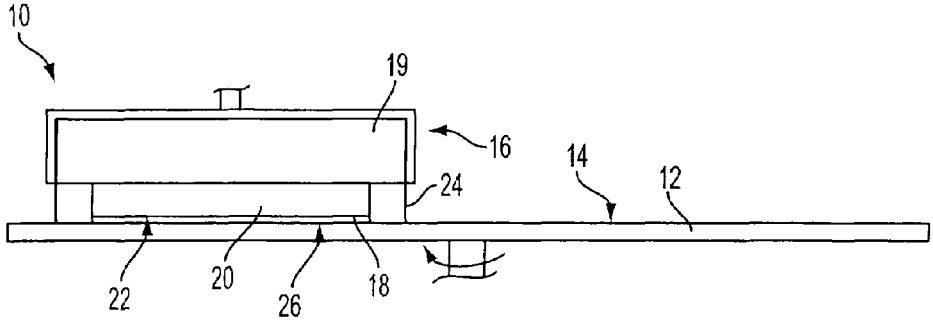
FIG. 1 (PRIOR ART)
FIG. 1 (prior art) is a sectional side view of a conventional CMP apparatus illustrating a platen having a polishing surface and a polishing head for holding a substrate thereon.
Figure 2A:
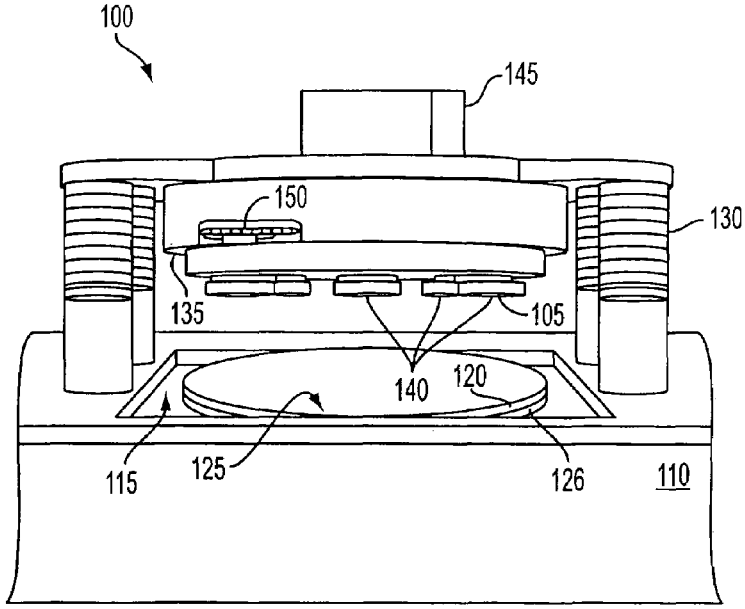
FIG. 2A is a sectional side view of a CMP apparatus having a polishing head with a retaining ring with a contoured lower surface according to an embodiment of the present invention.

Referring to FIG. 2A, there is shown an embodiment of a chemical mechanical polishing or planarization (CMP) apparatus 100 for polishing substrates 105. This particular embodiment provides multiple heads in a carousel arrangement, however, other types of single head machines are known. As used here the term "polishing" means either polishing or planarization of substrates 105, including substrates used in optical systems, windows, flat panel displays, solar cells, and, in particular, semiconductor substrates or wafers on which electronic circuit elements have been or will be formed. Semiconductor wafers are typically thin and fragile disks having diameters nominally between about 100 and about 400 millimeters (mm). Currently 100, 200, 300 and 400 mm semiconductor wafers are widely used in the industry. The inventive method and apparatus 100 are applicable to semiconductor wafers and other substrates 105 at least up to 400 mm diameter as well as to larger diameter substrates, such as for example flat panel LCD displays having 16 inch or larger diameters.

For purposes of clarity, many of the details of the CMP apparatus 100 that are widely known and are not relevant to the present invention have been omitted. CMP apparatuses 100 are described in more detail in, for example, in commonly assigned, co-pending U.S. Pat. No. 6,506,105, filed 12 May 2000 and entitled System and Method for Pneumatic Diaphragm CMP Head Having Separate Retaining Ring and Multi-Region Wafer Pressure Control; U.S. patent application Ser. No. 09/570,369, filed 12May 2000 and entitled System and Method for CMP Having Multi-Pressure Zone Loading For Improved Edge and Annular Zone Material Removal Control; and U.S. Provisional Application Ser. No. 60/204,212, filed 12May 2000 and entitled System and Method for CMP Having Multi-Pressure Annular Zone Subcarrier Material Removal Control, each of which is incorporated herein by reference in its entirety.

The CMP apparatus 100 includes a base 110 rotatably supporting a large rotatable platen 115 with a polishing pad 120 mounted thereto, the polishing pad having a polishing surface 125 on which the substrate 105 is polished. The polishing pad 120 is typically a flexible, compressible or deformable material, such as a polyeurethane polishing pad available from RODEL Inc., of Newark, Del. Additionally, a number of underlying pads 126 can be mounted between the polishing pad 120 and the polishing platen 115 to provide a flatter polishing surface 125 having better contact with the surface of the substrate 105. Recesses (not shown), such as grooves or cavities, may be provided in the polishing surface 125 to distribute a polishing fluid such as a chemical or slurry between the polishing surface and a surface of a substrate 105 placed thereon. By slurry it is meant a chemically active liquid having an abrasive material suspended therein that is used to enhance the rate at which material is removed from the substrate surface. Typically, the slurry is chemically active with at least one material on the substrate 105 and has a pH of from about 2 to about 11. For example, one suitable slurry consists of approximately 12% abrasive and 1% oxidizer in a water base, and includes a colloidal silica or alumina having a particle size of approximately 100 nanometers (nm). Optionally, as an alternative or in addition to the slurry, the polishing surface 125 of the polishing pad 120 can have a fixed abrasive material embedded therein, and the chemical dispensed onto the polishing surface during polishing operations can be water or deionized water. The base 110 also supports a bridge 130 that in turn supports a carousel 135 having one or more polishing heads 140 on which substrates 105 are held during a polishing operation. The bridge 130 is designed to permit raising and lowering of the carousel 135 to bring surfaces of substrates 105 held on the polishing heads 140 into contact with the polishing surface 125 during the polishing operation. The particular embodiment of a CMP apparatus 100 shown in FIG. 2A is a multi-head design, meaning that there are a plurality of polishing heads 140 on the carousel 135; however, single head CMP apparatuses are known, and the inventive polishing head 140 and methods for polishing may be used with either a multi-head or single-head CMP apparatus. Furthermore, in this particular design, each of the polishing heads 140 are driven by a single motor 145 that drives a chain 150, which in turn drives each of the polishing heads via a chain and sprocket mechanism (not shown); however, the invention may be used in embodiments in which each polishing head 140 is rotated with a separate motor and/or by other than chain and sprocket type drives. In addition to the rotation of the polishing pad 120 and the polishing heads 140, the carousel 135 can be moved in an orbital fashion about a fixed central axis of the polishing platen 115 to provide an orbital motion to the polishing heads. Furthermore, the inventive polishing head 140 may be utilized in all manner of CMP apparatuses 100 including machines utilizing a linear or reciprocating motion.

The CMP apparatus 100 also incorporates a chemical dispensing mechanism (not shown) to dispense a chemical or slurry, as described above, onto the polishing surface 125 during the polishing operation, a controller (not shown) to control the dispensing of the slurry and movement of the polishing heads 140 on the polishing surface, and a rotary union (not shown) to provide a number of different fluid channels to communicate pressurized fluids such as air, water, vacuum, or the like between stationary sources external to the polishing head and locations on or within the polishing head.

A CMP apparatus 100 having a plurality of polishing heads 140 mounted on carousel 135 is described in U.S. Pat. No. 4,918,870 entitled Floating Subcarriers for Wafer Polishing Apparatus; a CMP apparatus 100 having a floating polishing head 140 is described in U.S. Pat. No. 5,205,082 Wafer Polisher head Having Floating Retainer Ring; and a rotary union for use in a polishing head 140 is described in U.S. Pat. No. 5,443,416 and entitled Rotary Union for Coupling Fluids in a Wafer Polishing Apparatus; each of which are hereby incorporated by reference.

Figure 2B:
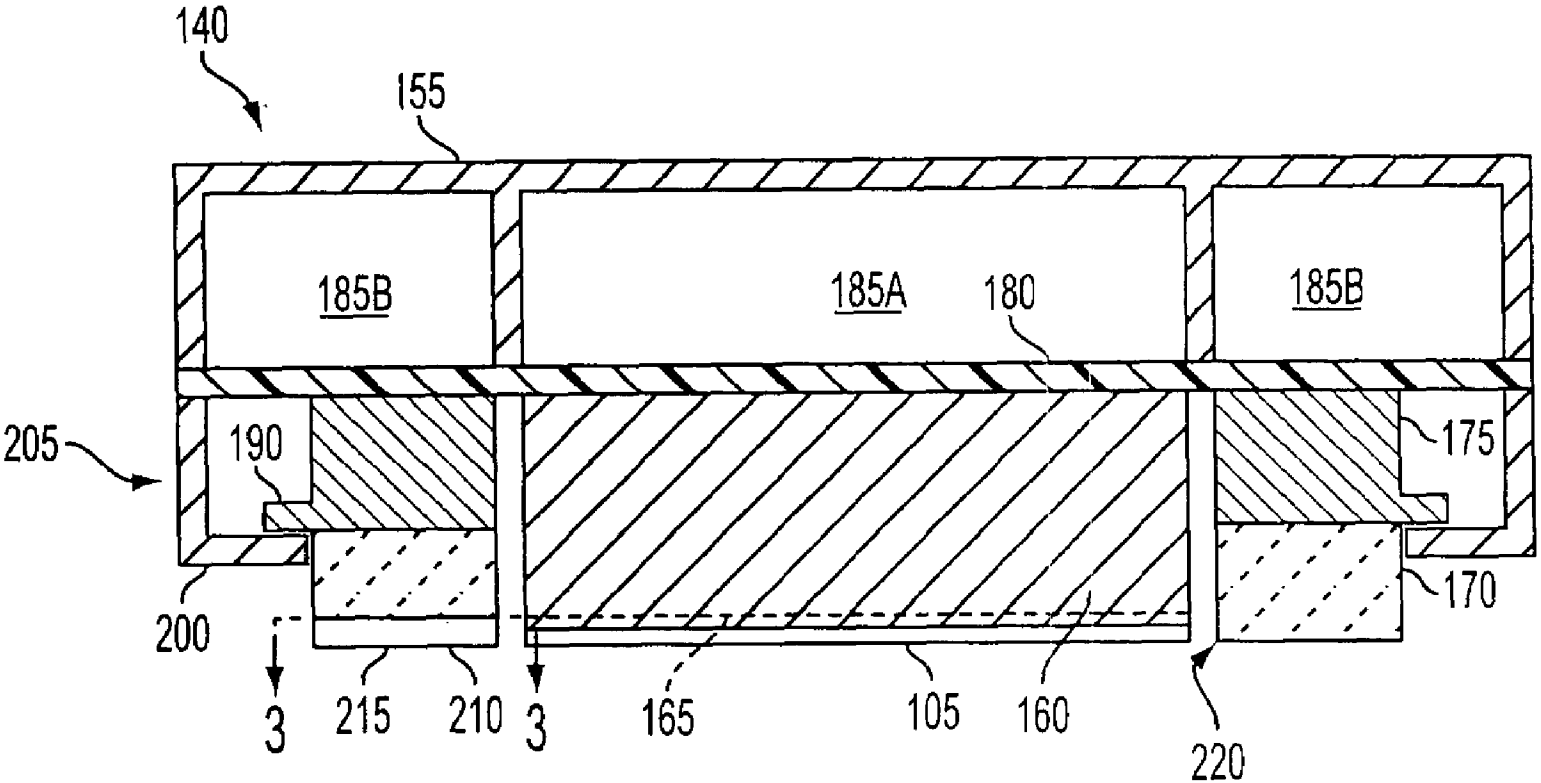
FIG. 2B is a sectional side view of the polishing head of FIG. 2A.

An embodiment of a polishing head 140 according to the present invention will now be described with reference to FIG. 2B. Referring to FIG. 2B, the polishing head 140 includes a carrier 155 for holding and positioning the substrate 105 on the polishing surface 125 during the polishing operation. The carrier 155 typically includes a subcarrier 160 having a lower surface 165 on which the substrate 105 is held and a retaining ring 170 circumferentially disposed about a portion of the subcarrier. Generally, the polishing head 140 further includes a backing ring 175 for supporting and applying force to the retaining ring 170.

The subcarrier 160 and the backing ring 175, with the retaining ring 170 attached thereto, are suspended from the carrier 155 in such a way that they can move vertically with little friction and no binding. Small mechanical tolerances are provided between the subcarrier 160 and the retaining ring 170 and adjacent elements so that they are able to float on the polishing surface 125 in a manner that accommodates minor angular variations during the polishing operation.

Referring to FIG. 2B, a gasket or flexible membrane 180 is joined via an adhesive or mechanical fastener (not shown) to the carrier 155 to form closed chambers or cavities 185A, 185B, above the subcarrier 160 and the backing ring 175 respectively. The subcarrier 160 and the backing ring 175 are also joined to the flexible membrane 180 via an adhesive or mechanical fastener (not shown) in such a way as to enable the subcarrier and the backing ring to move relative to one another and to the carrier 155 during the polishing operation. The backing ring 175 includes a projection or lip 190 along an outer surface that engages with a similar lip 200 on a skirt portion 205 of the carrier 155 to limit the downward movement of the retaining ring and to support the weight of the retaining ring 170 and subcarrier 160 when, for example, the polishing head 140 is lifted from the polishing surface 125.

In operation, the subcarrier 160 and the retaining ring 170 are independently or at least substantially independently biased or pressed against the polishing surface 125 while providing a slurry and relative motion between the substrate 105 and the polishing surface 125 to polish the substrate. The biasing force can be provided by springs (not shown), by the weight of the subcarrier 160 and the retaining ring 170 themselves or by a pressurized fluid. Preferably, as shown in FIG. 2B, the subcarrier 160 and the retaining ring 170 are pressed against the polishing surface 125 by a pressurized fluid introduced into the cavities 185A, 185B. The use of a pressurized fluid is preferred since the application of the force is more uniform and more readily altered to adjust the polishing or removal rate. Generally, the pressure applied is in the range of between about 4.5 and 5.5 pounds per square inch (psi), more typically about 5 psi. However, these ranges are only exemplary as any of the pressures may be adjusted to achieve the desired polishing or planarization effects over the range from about 1 psi and about 10 psi. More preferably, the biasing force or pressure applied to the retaining ring 170 is usually greater than that applied to the subcarrier 160 to slightly deform the polishing surface 125 thereby reducing the edge effect and providing a more uniform rate of removal and planarization across the surface of the substrate 105. The edge effect refers to the tendency for the rate of removal of material to be greater at the surface near the edge of a substrate 105 than at a central portion due to the interaction of the polishing surface 125 with the edge of the substrate. By pressing down on and slightly deforming the polishing surface 125 near the edge of the substrate 105, the retaining ring 170 reduces the force with which the edge of the substrate is pressed against or encounters the polishing surface, thereby lowering the local removal rate to a level more nearly equal to that of other areas across the substrate surface.

In accordance with the present invention, the retaining ring 170 further includes a number of grooves 215 in the lower surface 210 thereof for distributing a chemical or slurry between the surface of the substrate 105 and the polishing surface 125, which will now be described with reference to FIGS. 3 to 7.

Figure 3:
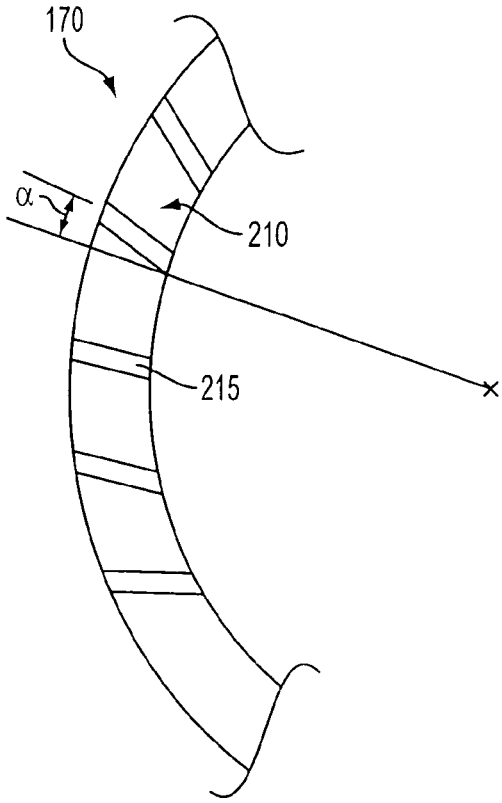
FIG. 3 is a partial plan view of a lower surface of a retaining ring having a slurry distributing groove therein according to an embodiment of the present invention.

FIG. 3 is a partial plan view of a lower surface 210 of a retaining ring 170 having a slurry distributing groove 215 therein according to an embodiment of the present invention. In the embodiment shown in FIG. 3 the groove 215 comprises a straight line shape extending from an area near an outer edge of the retaining ring 170 to an area near an inner edge of the retaining ring. The groove 215 in this embodiment can be angled relative to a radius of the retaining ring, as shown, or substantially parallel to it (not shown). It will be appreciated that where there are a plurality of angled grooves, each of the grooves can be angled in a different direction or to a different degree than the other grooves.

Figure 4:
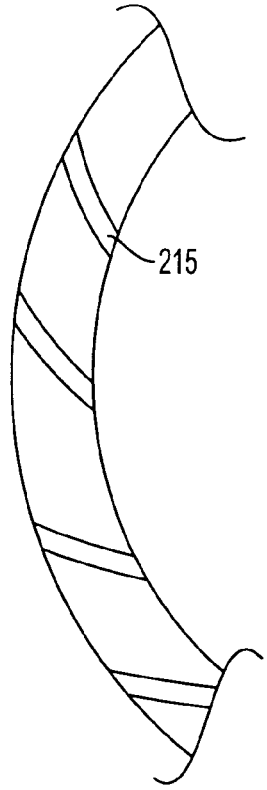
FIG. 4 is a partial plan view of a lower surface of a retaining ring having a slurry distributing groove therein according to another embodiment of the present invention.

FIG. 4 is a partial plan view of a lower surface 210 of a retaining ring 170 having a slurry distributing groove 215 therein according to another embodiment of the present invention. In the embodiment shown in FIG. 4 the groove 215 comprises a curved line shape extending from an area near an outer edge of the retaining ring 170 to an area near an inner edge of the retaining ring. Again, it will be appreciated that where there are a plurality of curved grooves, each of the grooves can be curved in a different direction or to a different degree than the other grooves.

Figure 5:
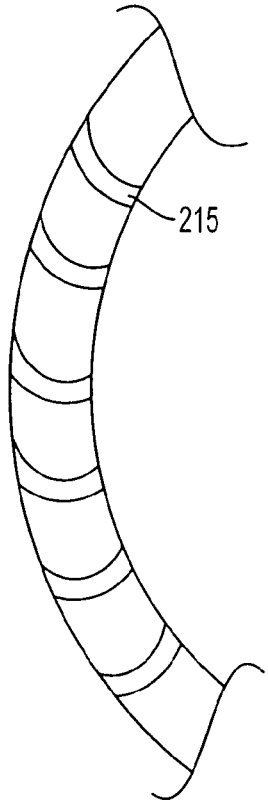
FIG. 5 is a partial plan view of a lower surface of a retaining ring having a slurry distributing groove therein according to another embodiment of the present invention.

FIG. 5 is a partial plan view of a lower surface 210 of a retaining ring 170 having a slurry distributing groove 215 therein according to another embodiment of the present invention. In the embodiment shown in FIG. 5 the groove 215 comprises an arced line shape extending from an area near an outer edge of the retaining ring 170 to an area near an inner edge of the retaining ring. Again, it will be appreciated that where there are a plurality of curved grooves, each of the arced grooves can be arced in a different direction or to a different degree than the other grooves.

Figure 6:
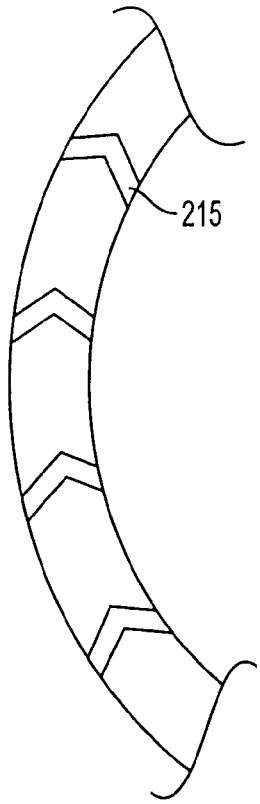
FIG. 6 is a partial plan view of a lower surface of a retaining ring having a slurry distributing groove therein according to another embodiment of the present invention.

FIG. 6 is a partial plan view of a lower surface 210 of a retaining ring 170 having a slurry distributing groove 215 therein according to yet another embodiment of the present invention. In the embodiment shown in FIG. 6 the groove 215 comprises a chevron shaped line extending from an area near an outer edge of the retaining ring 170 to an area near an inner edge of the retaining ring. Preferably, the chevron shape is oriented such that an apex of the chevron points in a direction corresponding to a direction of rotation of the retaining ring 170 or polishing head. Alternatively, the chevron shape can be oriented such that an apex of the chevron points in a direction opposite to a direction of rotation of the retaining ring 170 or polishing head. Again, it will be appreciated that where there are a plurality of chevron shaped grooves, each of the grooves can have an apex oriented in a different direction than the other grooves. Additionally, the where there are a plurality of chevron shaped grooves, each of the grooves can have separate halves which form a different angle at their apex than the other grooves.

In the embodiments disclosed in FIGS. 5 and 6, it is important that a groove is angled at least once between the outer and inner edge of the retaining ring 170. Further, the directions of a groove at an inner edge and an outer edge of the retaining ring 170 are oriented to a same direction with respect to a direction of a rotation of the retaining ring 170 or the polishing head. In the present invention, "same direction with respect to a direction of a rotation of the retaining ring" does not necessarily mean same angle with respect to a direction of a rotation of the retaining ring, i.e. when a groove at a inner edge of the retaining ring 170 is oriented upstream of a rotation of the retaining ring 170, the groove at an outer edge of the retaining ring is also oriented upstream of a rotation of the retaining ring.

According to an angled groove, slurry stagnation is made about an the apex of the groove, whereby slurry distribution between the surface of the substrate 105 and the polishing surface 125 is enhanced and slurry once introduced below the substrate is does not flowed flow out excessively. The angle of the groove may be an arced line shape as shown in FIG. 5 or a chevron shaped as shown in FIG. 6. The groove at the inner and outer edge of the retaining ring 170 may be oriented in a same direction or an opposite direction of the rotation of the retaining ring 170 or the polishing head 140. It is not necessary all grooves are oriented in a same direction. A plurality of angles may be made in one groove.

Figure 7:
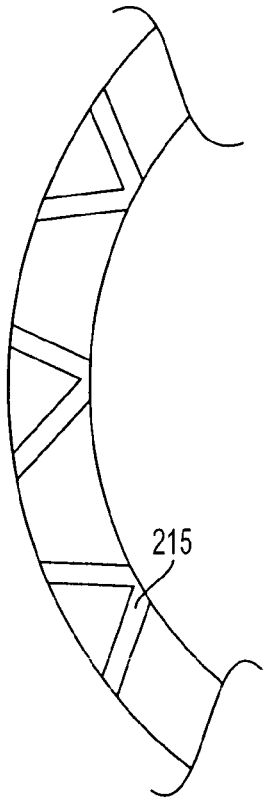
FIG. 7 is a partial plan view of a lower surface of a retaining ring having a slurry distributing groove therein according to another embodiment of the present invention.

FIG. 7 is a partial plan view of a lower surface 210 of a retaining ring 170 having a slurry distributing groove 215 therein according to still another embodiment of the present invention. In the embodiment shown in FIG. 7 the groove 215 comprises a chevron shaped groove 215 having an apex that intersects the inner edge of the retaining ring. Alternatively, the apex that intersects the inner edge of the retaining ring 170 (not shown). Again, it will be appreciated that where there are a plurality of chevron shaped grooves, each of the grooves can have an apex oriented in a different direction than the other grooves. Additionally, the where there are a plurality of chevron shaped grooves, each of the grooves can have separate halves which form a different angle at their apex than the other grooves.

Figure 8:
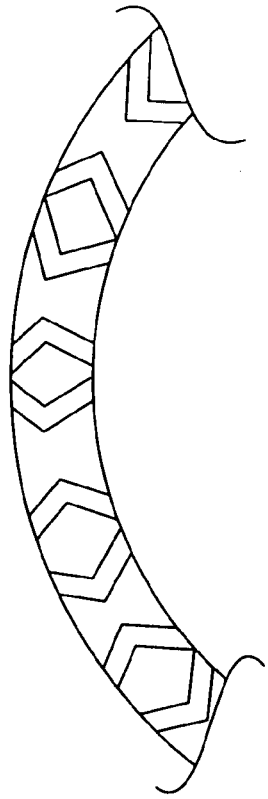
FIG. 8 is a partial plan view of a lower surface of a retaining ring having a slurry distributing groove therein according to still another embodiment of the present invention.

FIG. 8 is a partial plan view of a lower surface 210 of a retaining ring 170 having a slurry distributing groove 215 therein according to still another embodiment of the present invention. In the embodiment shown in FIG. 8 a plurality of groves 215 are configured in chevron shaped grooves and oriented in opposite directions alternately with respect to a direction of the rotation of the retaining ring 170. A polishing liquid is distributed between the surface of the substrate 105 and the polishing surface 125 efficiently by making such a configuration that the groove has an crooked angled point midway, and the directions of each groove at an inner edge and an outer edge of the retaining ring 170 are oriented to a same direction with respect to a direction of a rotation of the retaining ring 170 or the polishing head 140.

Figure 9:
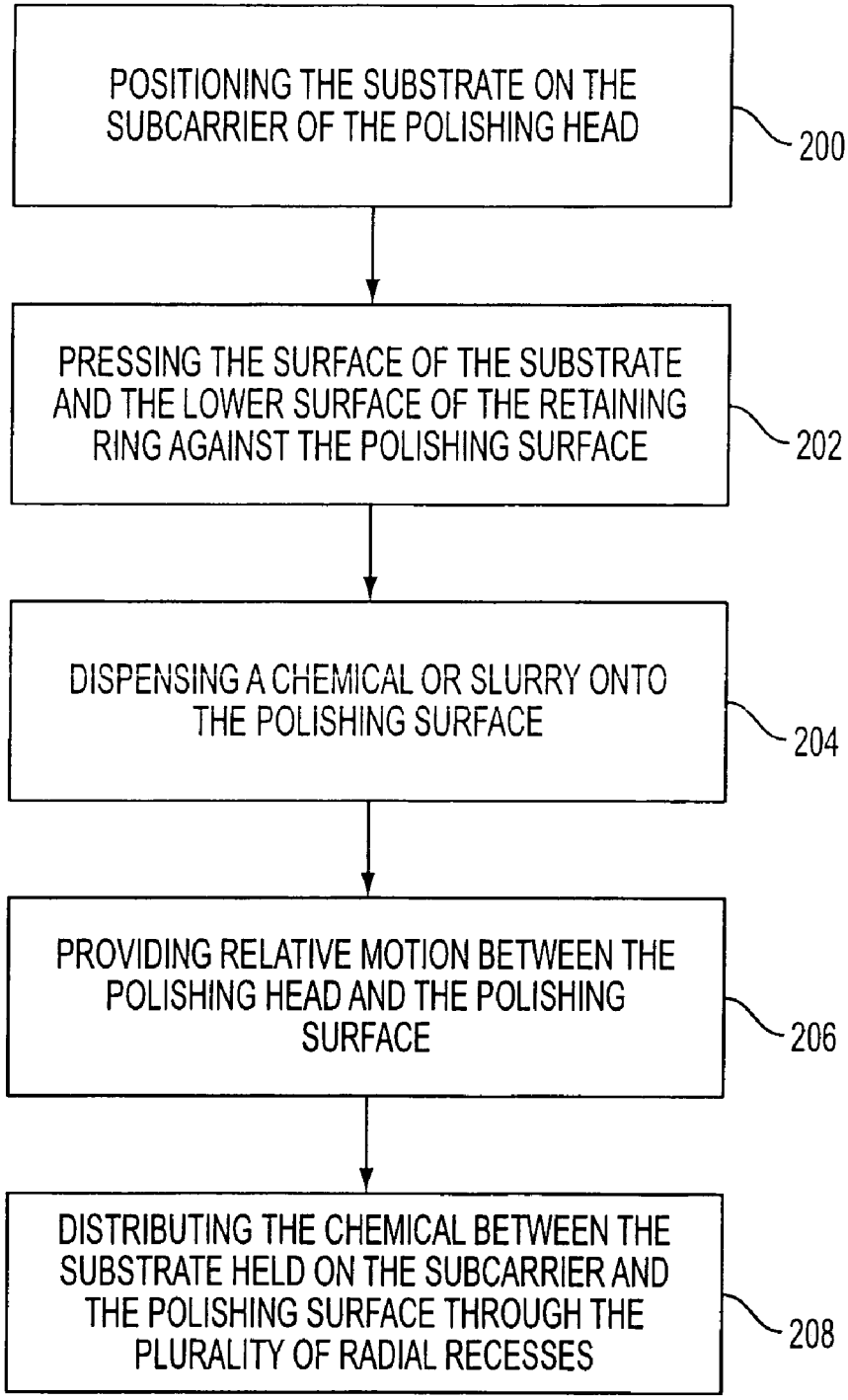
FIG. 9 is a flowchart showing an embodiment of a process for polishing or planarizing a substrate according to an embodiment of the present invention.

A method of operating a CMP apparatus 100 according to the present invention will now be described with reference to FIG. 9. FIG. 9 is a flowchart showing an embodiment of a process for polishing or planarizing a substrate 105 according to an embodiment of the present invention. Generally, the method involves: (i) positioning the substrate 105 on the subcarrier 160 of the polishing head 140 (step 200); (ii) pressing the surface of the substrate 105 and the lower surface 210 of the retaining ring 170 against the polishing surface 125 (step 202); (iii) dispensing a chemical or slurry onto the polishing surface 125 (step 204); (iv) providing relative motion between the polishing head 140 and the polishing surface 125 (step 206); and (v) distributing the chemical between the substrate 105 held on the subcarrier 160 and the polishing surface 125 through the plurality of radial recesses 215 (step 208).

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best use the invention and various embodiments with various modifications as are suited to the particular use contemplated. It is intended that the scope of the invention be defined by the claims appended hereto and their equivalents.

We claim:

1. A polishing head for positioning a surface of a substrate against a polishing surface, the polishing head comprising:

a subcarrier adapted to hold the substrate during a polishing operation; and a retaining ring having an inner edge disposed about the subcarrier and a lower surface in contact with the polishing surface during the polishing operation, the lower surface of the retaining ring having a number of radial recesses formed therein to distribute a chemical between the substrate held on the subcarrier and the polishing surface when there is relative motion between the substrate and the polishing surface, at least two of said recesses define a segment of the retaining ring, the segment having a leading edge comprising a chevron shape and a trailing edge comprising a chevron shape, wherein the leading edge chevron shape and the trailing edge chevron shape are oriented in opposite directions, and wherein each chevron shape comprises an inner groove portion from the inner edge of the retaining ring to an apex and an outer groove portion from an outer edge of the retaining ring to the apex, said inner groove portion and said outer groove portion forming the only outlets from the apex.

2. A polishing head according to claim 1, wherein each of the number of radial recesses comprise a chevron shape.

3. A polishing head according to claim 1, wherein each of the number of radial recesses comprise a chevron shape, and wherein the chevron shapes of adjacent radial grooves are oriented in opposite directions.

4. A method of polishing a substrate having a surface using a polishing apparatus comprising a polishing surface, a polishing head having a subcarrier and a retaining ring having an inner edge disposed about the subcarrier and a lower surface in contact with the polishing surface during the polishing operation, the lower surface of the retaining ring having a plurality of radial recesses formed therein, at least one of the radial recesses comprising a groove, the method comprising:

positioning the substrate on the subcarrier;

pressing the surface of the substrate and the lower surface of the retaining ring against the polishing surface;

dispensing a chemical onto the polishing surface;

providing relative motion between the polishing head and the polishing surface; and distributing the chemical between the substrate held on the subcarrier and the polishing surface through the plurality of radial recesses, wherein at least two of said recesses define a segment of the retaining ring, the segment having a leading edge comprising a chevron shape and a trailing edge comprising a chevron shape, and wherein the leading edge chevron shape and the trailing edge chevron shape are oriented in opposite directions, and further wherein each chevron shape comprises an inner groove portion from the inner edge of the retaining ring to an apex and an outer groove portion from the outer edge of the retaining ring to the apex, said inner groove portion and said outer groove portion forming the only outlets from the apex.

5. A polishing head for positioning a surface of a substrate against a polishing surface, the polishing head comprising:

a retaining ring having an inner edge and a lower surface in contact with the polishing surface during the polishing operation, the lower surface of the retaining ring having a number of radial recesses formed therein to distribute a chemical between the substrate and the polishing surface when there is relative motion between the substrate and the polishing surface, at least two of said recesses define a segment of the retaining ring, the s&gment having a leading edge comprising a chevron shape and a trailing edge comprising a chevron shape, wherein the leading edge chevron shape and the trailing edge chevron shape are oriented in opposite directions, and wherein each chevron shape comprises an inner groove portion from the inner edge of the retaining ring to an apex and an outer groove portion from an outer edge of the retaining ring to the apex, said inner groove portion and said outer groove portion forming the only outlets from the apex.

6. A polishing head according to claim 5, wherein each of the number of radial recesses comprise a chevron shape.

7. A polishing head according to claim 5, wherein each of the number of radial recesses comprise a chevron shape, and wherein the chevron shapes of adjacent radial grooves are oriented in opposite directions.

8. A polishing head according to claim 5, further comprising a subcarrier disposed within the inner edge of the retaining ring and adapted to hold the substrate during a polishing operation.

9. A method of polishing a substrate having a surface using a polishing apparatus comprising a polishing surface, a polishing head having retaining ring having an inner edge and a lower surface in contact with the polishing surface during the polishing operation, the lower surface of the retaining ring having a plurality of radial recesses formed therein, at least one of the radial recesses comprising a groove, the method comprising:

positioning the substrate within the inner edge of the retaining ring;

pressing the surface of the substrate and the lower surface of the retaining ring against the polishing surface; dispensing a chemical onto the polishing surface; providing relative motion between the polishing head and the polishing surface; and distributing the chemical between the substrate held within the inner edge of the retaining ring and the polishing surface through the plurality of radial recesses, wherein at least two of said recesses define a segment of the retaining ring, the segment having a leading edge comprising a chevron shape and a trailing edge comprising a chevron shape, and wherein the leading edge chevron shape and the trailing edge chevron shape are oriented in opposite directions, and further wherein each chevron shape comprises an inner groove portion from the inner edge of the retaining ring to an apex and an outer groove portion from the outer edge of the retaining ring to the apex, said inner groove portion and said outer groove portion forming the only outlets from the apex.

10. A method of polishing a substrate according to claim 9, wherein the polishing head further comprises a subcarrier disposed within the inner edge of the retaining ring and adapted to hold the substrate during a polishing operation, the method further comprising:

positioning the substrate on the subcarrier within the inner edge of the retaining ring; and distributing the chemical between the substrate held within the inner edge of the retaining ring on the subcarrier and the polishing surface through the plurality of radial recesses.

11. A retaining ring for use in a polishing head for retaining a surface of a substrate against a polishing surface, the retaining ring having an inner edge and a lower surface in contact with the polishing surface during the polishing operation, the lower surface of the retaining ring having a number of radial recesses formed therein to distribute a chemical between the substrate and the polishing surface when there is relative motion between the substrate and the polishing surface, at least two of said recesses define a segment of the retaining ring, the segment having a leading edge comprising a chevron shape and a trailing edge comprising a chevron shape, wherein the leading edge chevron shape and the trailing edge chevron shape are oriented in opposite directions, and wherein each chevron shape comprises an inner groove portion from the inner edge of the retaining ring to an apex and an outer groove portion from an outer edge of the retaining ring to the apex, said inner groove portion and said outer groove portion forming the only outlets from the apex.

12. A retaining ring for use in a polishing head according to claim 11, wherein each of the number of radial recesses comprise a chevron shape.

13. A retaining ring for use in a polishing head according to claim 11, wherein each of the number of radial recesses comprise a chevron shape, and wherein the chevron shapes of adjacent radial grooves are oriented in opposite directions.

14. A retaining ring for use in a polishing head according to claim 11, further comprising a subcarrier disposed within the inner edge of the retaining ring and adapted to hold the substrate during a polishing operation.

* * * * *